United States Patent [19]

Nieskens et al.

[11] 4,027,459

[45] June 7, 1977

[54] SEALING MACHINE

[75] Inventors: Antonius Nieskens, Nederweert; Petrus Slenders, Ospel; Christian Palmkoeck, Weert, all of Netherlands

[73] Assignee: Robert Bosch G.m.b.H., Stuttgart, Germany

[22] Filed: Apr. 29, 1976

[21] Appl. No.: 681,481

[30] Foreign Application Priority Data

May 2, 1975 Germany ..... 2519645

[52] U.S. Cl. ..... 53/59 R; 53/55; 53/78; 53/244

[51] Int. Cl.[2] ..... B65B 57/20

[58] Field of Search ..... 53/55, 59 R, 78

[56] References Cited

UNITED STATES PATENTS

| | | | |
|---|---|---|---|
| 3,587,688 | 6/1971 | Toby | 53/55 X |
| 3,842,573 | 10/1974 | Price | 53/78 X |
| 3,955,335 | 5/1976 | Yates | 53/55 |

*Primary Examiner*—Travis S. McGehee
*Attorney, Agent, or Firm*—Edwin E. Greigg

[57] ABSTRACT

The invention relates to packaging machines wherein a web of flexible material is transformed into a tube, filled, sealed and discharged onto a conveyor mechanism, the completed package being then transported to a positioning device where it is deposited in a shipping case.

The packaging and shipping case loading machines are coordinated by a plurality of sensor means which preclude the necessity of an operator having to start and stop the machines when a filled shipping case is removed from the platform and supplanted by an empty one.

2 Claims, 2 Drawing Figures

SEALING MACHINE

BACKGROUND OF THE INVENTION

The invention relates to a packaging machine which comprises a system for continuously fabricating packages and of a device to bring these packages by means of a deposition head into shipping cases, and further comprises a conveyor system which is arranged to advance the packages in seriatim from the point where the packages are made to the point where they are deposited into the shipping case.

An arrangement for depositing objects such as pouches in a receptacle of this general type is disclosed in U.S. Pat. No. 3,710,543. However, the teaching of this disclosure requires a temporary shutdown of the mechanism at the time when a filled receptacle is moved away from the loading point and in order to replace said filled case with an empty receptacle. The only other alternatives to such a shutdown are to have the mechanism run at idle, or else, the bags delivered during this time must be removed by hand. In either case, an operator is needed.

OBJECT AND SUMMARY OF THE INVENTION

The principal object of the present invention is to so design the packaging machine of the aforementioned type that it will be self-monitoring and self-controlling, and in that shutdown or idle operation of the packaging system is as short as possible when it becomes necessary to replace a filled receptacle with an empty receptacle.

Accordingly, this problem is solved by the present invention by placing a barrier in the path of travel of the completed package as it travels from the packaging mechanism to the point where a receptacle is positioned, said barrier being brought into its blocking position when a counter associated with the zone where the receptacle is held has determined the passage of a particular, given number of packages, this counter also causing shutdown of operation in the packaging system and blocking of the deposition head.

Because the barrier holds back one package during the time of changing the receptacles while a second package is also retained in the deposition head of the loading system, the entire packaging system may remain operational almost up to the very time the change in receptacles is made and may resume operation immediately thereafter.

In a further embodiment of the invention, the barrier is mounted at the beginning of the conveyor system. Preferably, it will be in the form of a rocker-type element which receives the packages coming from the filling station.

An embodiment of the invention is shown in the drawing, and will be described in greater detail below.

DESCRIPTION OF THE PREFERRED EMBODIMENT

Figures 1, 2:
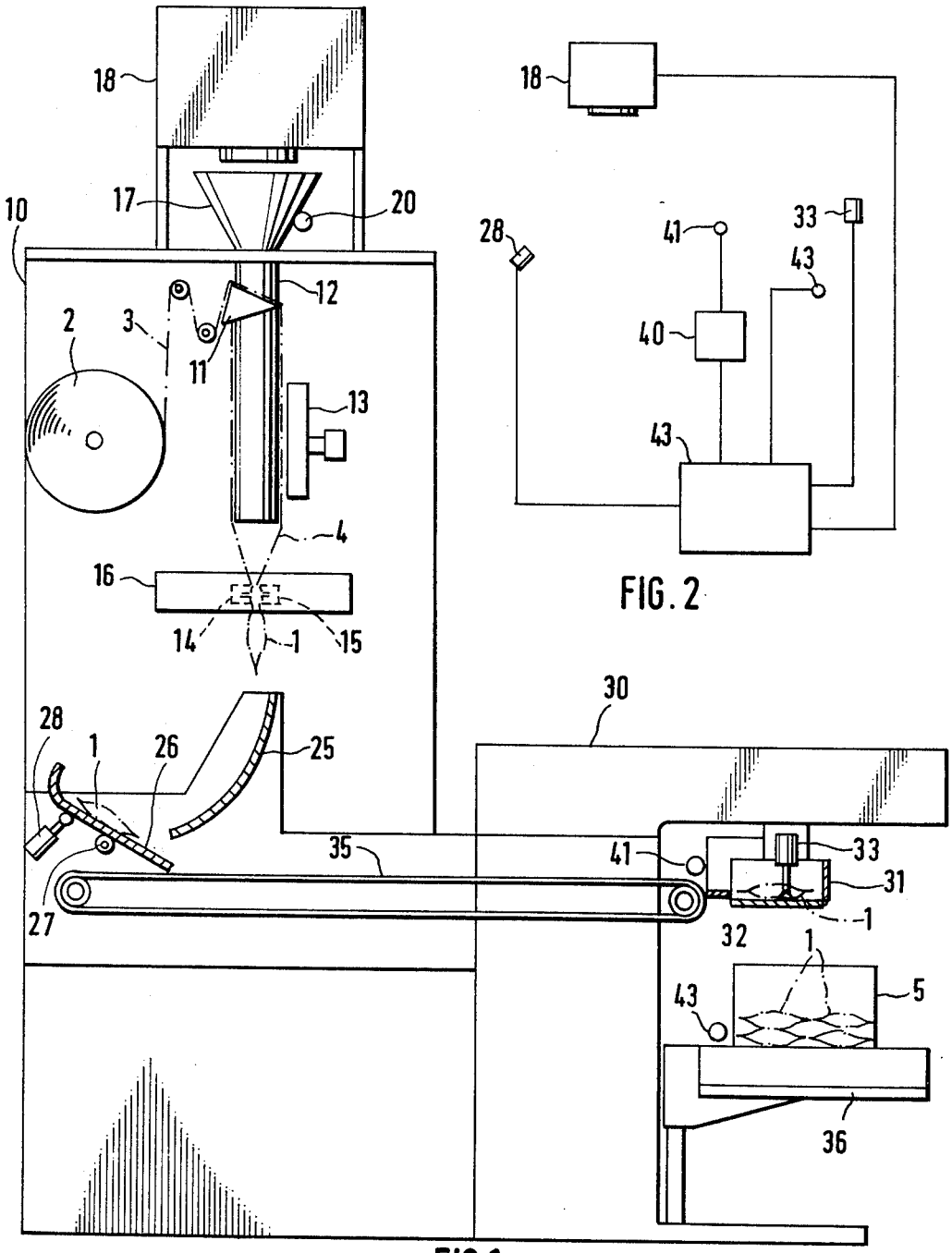
FIG. 1 is a schematic view of the package forming mechanism showing a machine making bags from tubular material and their later progress toward a point where they are accumulated in receptacles.
FIG. 2 is a simplified circuit diagram of the packaging machine of FIG. 1.

Turning now to the drawing, the bagging machine 10 comprises a web shaping element 11 which causes the web to be formed about the length of a tubular mouth shaping and filling pipe 12. Also clearly shown is a sealing jaw 13 which causes the downwardly moving edges of the web 3 to be sealed together to form a closed elongated tube and positioned beneath the sealing jaw 13 are a pair of laterally movable sealing jaws 14 and 15 that are carried in a vertically movable frame 16 with the mechanism being so arranged that the frame 16 and the pair of sealing jaws 14 and 15 can be coordinated to cause the bags filled with a predetermined quantity of a material to be pulled downwardly, sealed, then severed from the tubular stock and discharged toward the conveyor. A funnel 17 is located above the shaping element 11 and filling pipe 12. Positioned above the funnel is a suitable filling system 18 which is arranged to deliver pre-selected portions of the product to be packaged, and includes for instance an automatic weighing balance, a metering system or a conveyor mechanism which will supply a pre-measured amount of the product. The web 3 is unwound from roll 2 and is caused to pass over the shaping element 11 and then formed around the shaping and filling pipe into a tube 4. The vertical exposed edges of the packaging material are joined together by the lengthwise sealing jaw 13 thus forming the tube, as shown. The end of the tube is compressed by the transverse jaws 14, 15 and sealed together. After a metered portion has been discharged from the filling system 18 through funnel 17 and shaping and filling pipe 12 into the end of the tube, the transverse sealing jaws 14, 15 are moved towards one another in the upper position of frame 16 whereupon they separate a package 1 in the form of a pouch or bag, from the tube end and fabricate a top seam in said bag as well as a bottom seam for the subsequent bag package during the subsequent descent of frame 16 in the course of which the web 3 and tube 4 are pulled off. Simultaneously, the package 1 is severed from tube 4.

The bag makng machine 10 is designed in known manner so that no bag or pouch will be made if the tube is not being filled. To that end, the machine is provided with a sensor or scanner 20 provided in the area of the funnel 17 which will prevent the mutual approach of the transverse sealing jaws 14, 15 when the bag is empty, whereby the tube end will not be seized and frame 16 will carry out only a dummy stroke, all of which is known in the prior art.

A completely filled package 1 will be fabricated upon separation of the transverse sealing jaws 14 and 15 and fall downwardly onto the chute 25 and then slide onto the rocker member 26. If the rocker member is in one of two alternative positions—in this case, the one shown—and in which its slope is opposite to that of chute 25, then the package will experience a reversal in direction, as shown in FIG. 1. However, if the rocker member 26 is in its other alternate position, namely a substantially horizontal one, then it functions as a barrier and the bag 1 will be caught and remain on said rocker member until a suitable signal or pulse is sent to the actuator 28 so that the rocker member 26 can pivot into the position shown in the drawing, whereupon the package will be discharged to the conveyor.

The machine for receiving the bags and depositing them in cartons stands next to the bag-making machine 10. This machine is provided with a head 31 which may be positioned into positions of a definite deposition pattern of the bags so they are placed in the cartons in a uniform manner. The head 31 is provided with bottom plates 32 which are actuated by cylinder 33, the construction being such that the bottom plates swing out of the way when said cylinder actuates them. A continuously operating conveyor belt 35 which starts below the rocker member 26 carries packages to the deposition head 31. Beneath the head 31 is located a platform 36 which supports a carton. Should the rocker member 26 be in its tilted position, the finished packages 1 will glide therefrom onto the conveyor belt 35 from which they are sequentially brought into the deposition head 31. When the plates 32 of the deposition head pivot downward, the package 1 present therein falls into the carton 5. The deposition head 31 is arranged to assume, sequentially, a set of predetermined, different positions and at each interval drop a package 1.

In order to supply a given number of packages each time into the carton 5, provision is made for an adjustable counter 40. This counter receives a counting pulse from a photoelectric scanner 41 mounted at the terminal end of the path of the conveyor belt 35 adjacent to the deposition head 31 and thus senses each package as it passes this scanner. Sensor 41 is connected to a control unit 42 which can apply control pulses to the positioning cylinder 28 of rocker member 26, as well as the filling system 18 and to positioning cylinder 33 of the deposition head 31. Furthermore, control unit 42 is connected to a scanner 43 at the platform 36 which supports the receptacle.

A signal is transmitted by scanner 41 each time a package is dropped by the deposition head 31. At that time, control unit 42 then issues a pulse to positioning cylinder 33 of the deposition head 31, whereby the bottom plates 32 will be briefly opened. If the counter 40 has reached the count corresponding to the desired number of packages to be deposited in the carton 5, it will emit a signal to the control unit 42. At that time, control unit 42 stops the filling mechanism 18, whereupon bags no longer will be formed, and the positioning cylinder 28 is made to pivot rocker member 26 into a horizontal barrier forming position where it will remain until it receives a further pulse. At that time the control unit also restrains from giving a pulse to the cylinder 33. Therefore, the next package 1 entering the deposition head 31 will be retained there and that package which had been released by the transverse sealing jaws 14, 15 to the rocker member 26 which has moved into the barrier position continues to remain on said rocker member. After the filled carton 5 has been removed and an empty one has been readied on platform 36, scanner 43 issues a signal to control unit 42 which now resumes applying pulses to positioning cylinders 28 and 33 as well as to the filling system to resume operation. In this manner, pre-selected portions of the filling material are delivered and discrete packages are again fabricated while rocker member 26 is pivoted into the conveyance position and bottom plates 32 are once again arranged to be opened to fill the cartons 5.

What is claimed is:

1. A packaging machine comprising a system for continuously fabricating packages and of a device for introducing the same sequentially by means of a positioning and deposition head into a shipping case and of a conveyor system for bringing these packages spaced from each other from the packaging machine to a shipping case loading machine, characterized in that a barrier member is mounted adjacent to the starting end of said conveyor system from the packaging machine to the shipping case loading machine, said barrier member being brought into a substantially horizontal package retaining position whenever a given number of packages has passed a counter associated with the shipping case loading machine, said counter further effecting shut-down of the operation of the packaging machine and interrupting operation of the positioning and deposition head that loads packages into the shipping case.

2. A packaging machine as defined in claim 1, further characterized in that the barrier member is a rocker capable of assuming two positions and is arranged to receive packages coming from the packaging machine.

* * * * *